US006149023A

United States Patent [19]

Palmer

[11] Patent Number: 6,149,023

[45] Date of Patent: Nov. 21, 2000

[54] WIDE-MOUTH RECLOSABLE CONTAINER AND COVER WITH PIVOTING BAIL FASTENER

[76] Inventor: Kenneth S. Palmer, 5000 W. Lakeridge Rd., Denver, Colo. 80219

[21] Appl. No.: 09/224,403

[22] Filed: Dec. 31, 1998

[51] Int. Cl.[7] ..... B65D 45/04

[52] U.S. Cl. ..... 215/286; 215/289; 215/352; 220/322; 220/378; 81/3.55

[58] Field of Search ..... 215/285, 286, 215/289, 290, 293, 343, 344, 352; 220/243, 245, 246, 315, 322, 324, 378; 81/3.55, 3.57, 3.07

[56] References Cited

U.S. PATENT DOCUMENTS

| | | | |
|---|---|---|---|
| 326,625 | 9/1885 | Cassidy | 215/285 X |
| 328,115 | 10/1885 | Gilberds | 215/286 X |
| 360,165 | 3/1887 | Compte | 215/286 |
| 656,777 | 8/1900 | Robson | 215/293 X |
| 891,921 | 6/1908 | Foster | 215/286 |
| 1,348,231 | 8/1920 | McDonnell | 215/285 |
| 1,441,641 | 1/1923 | Thompson | 215/289 |
| 1,739,905 | 12/1929 | Kirkevold | 215/290 |
| 1,812,673 | 6/1931 | Algeo | 215/289 |
| 3,174,641 | 3/1965 | Kitterman | 215/343 X |
| 5,368,388 | 11/1994 | Fillon | 220/322 X |
| 5,836,465 | 11/1998 | King | 215/352 X |

*Primary Examiner*—Nathan J. Newhouse
*Attorney, Agent, or Firm*—Edwin H. Crabtree; Ramon L. Pizarro; Donald W. Mongolis

[57] ABSTRACT

A wide-mouth recloseable container and cover device with a pair of two-position bails used for holding liquids, powders and like substances. The device includes a container and a cover which are cylindrical in shape. The container has a lower portion and an upper portion. The upper portion has a wide-mouth opening with a top flange disposed around the opening. The top flange has a diameter approximately the same as the diameter of the lower portion of the container. The upper portion is "necked down" to provide room for six longitudinally oriented ribs. Four of the ribs are used for supporting opposite ends of two "U" shaped bails. The two bails are used for engaging opposite sides of an upper surface of the cover for holding a lower surface of the cover against the top flange of the container. The cover has an annular recess for receiving the top flange therein. In the top of the recess is an interior face having an annular "V"-shaped flexible seal and an annular "V"-shaped spacer therearound for providing minimum contact surface when engaging the top flange. Also, the upper surface of the cover includes a two pairs of upwardly extending bail ramps. Each bail ramp includes a temporary latch notch used for short-term storage and a more permanent lock notch used for long-term storage. The two pairs of notches are used for receiving an upper portion of each bail.

10 Claims, 2 Drawing Sheets

WIDE-MOUTH RECLOSABLE CONTAINER AND COVER WITH PIVOTING BAIL FASTENER

BACKGROUND OF THE INVENTION (a) Field of the Invention

This invention relates to containers and more particularly, but not by way of limitation, to a wide-mouth recloseable container and cover device for storing liquids such as paints and other substances temporarily or over a long-term.

(b) Discussion of Prior Art

Heretofore, due to automated, high-volume production methods, prior-art containers are very economical to manufacture. Also these containers provide excellent product protection from the time of filling until the contents are first used. In many instances, however, a container is not completely emptied during first use and a user closes and stores the remainder for later use. This procedure is especially common with commercial-quality paint and varnish products. Also, quite often a stored container of such material is re-opened and re-closed several times. In this situation, two major shortcomings of conventional containers become evident, frequently to the user's annoyance. If the container is sheet metal, usage of the contents invariably results in residue accumulating in the lid recess that surrounds the container opening. Unless wiped away before the lid is re-installed, the residue usually hardens and creates two problems: (1) The dried residue makes the next lid removal difficult and time consuming, and (2), the dried residue severely interferes with subsequent closing of the container. Typically, this residue will prevent the lid from properly re-seating and re-sealing, thereby allowing air entry. The air entry often leads to forming a crust over the contents. In such situations, the crust renders the contents virtually worthless and the container is then simply discarded with the its unusable contents therein.

Also, if the container is plastic, there usually is no recess in the edges around the top of the container opening. But, during usage, drips or other formations of excess material accumulate around the container's outer circumference. As with sheet-metal containers, such material hardens and ultimately prevents effective re-sealing of the cover, unless first wiped away. Again, a crust usually forms as a result of the container not being air tight, thereby effectively ruining the contents therein.

Another shortcoming of these conventional container constructions appears when the contained substance is toxic to the skin and/or internal organs. While suitable warnings of this characteristic are placed conspicuously on the label, it becomes the user's responsibility to store left-over product where young children cannot access it. When such a precaution is not taken, unfortunate consequences may result. Years ago, a similar hazard potential caused the pharmaceutical industry to employ childproof caps on medication containers. This concept has proven highly effective but, to date, this feature has not been provided on wide-mouth paint containers and other similar containers for storing like products.

U.S. Pat. No. 3,701,452 to Tonn discloses a sealing gasket used with a container and having a rotatable bolt and locking nut for securing a container lid on top of an upper flange of the container. U.S. Pat. Nos. 4,699,293 to Duchrow and 2,272,538 to Wirth describe two different types of electrical boxes with container lid seals. Either bolts or bails are used to retain the lid around the top of the open top electrical container box.

U.S. Pat. No. 5,085,337 to Kos illustrates a shock-resistant liquid container having a gasket system for sealing a cover on top of the container. Latches with hooks are used for engaging and compressing the cover on top of the container. U.S. Pat. Nos. 5,029,724 to Serio and 3,070,868 to Dell et al disclose two different types of locking systems for a hinged container lid and a burial vault.

None of the above mentioned prior art containers and container lids provide the unique combination of structure and features of the subject wide-mouth recloseable container and cover device for holding and storing liquids, powders and other substances for various lengths of time.

SUMMARY OF THE INVENTION

In view of the foregoing, it is a primary object of the subject invention to provide a wide-mouth recloseable container and cover for containment of liquids such as paint, and various other substances. The new container and cover device is specifically designed for providing effective storage and long-term sealing against spillage and air entry. Also the container and cover in combination provide a childproof locking system.

Another object of the invention is that the container and cover device may be made in a quart, a gallon or various sizes, depending on the requirement. The container and cover may be made of readily available types of plastics or metals and is designed to be relatively economical to manufacture.

Yet another object is the invention is to provide a convenient reusable storage container for "left-over" quantities of substances that originally are supplied in conventional, wide-mouth-receptacles. The container and cover device provide for easy and airtight sealing on a repetitive basis.

Still another object of the container and cover device is that the upper surface of the cover includes two pairs of upwardly extending bail ramps for receiving portions of each bail. Each bail ramp includes a temporary latch notch used for short-term storage and a permanent lock notch used for long-term storage.

A further object of the invention is the inclusion of a "Y"-shaped release tool. The tool is used for releasing the bail from the lock notch when the container has been used for long-term storage.

The container and cover device includes a container and a cover which are cylindrical in shape. The container has a lower portion and an upper portion. The upper portion has a wide-mouth opening with a top flange disposed around the opening. The top flange has a diameter nearly the same as the diameter of the lower portion of the container. The upper portion is "necked down" to provide room for six longitudinally oriented ribs. The ribs provide structural rigidity to the top flange. Four of them are used for supporting opposite ends of two "U"-shaped wire bails. The two bails are used for engaging opposite sides of an upper surface of the cover for holding a lower surface of the cover against the top flange of the container. The cover has an annular recess for receiving the top flange therein. In the top of the recess is an interior face having an annular, "V"-shaped flexible seal and an annular, "V"-shaped spacer therearound for providing a minimum of contact surface when engaging the top flange. Also, the upper surface of the cover includes two pairs of upwardly extending bail ramps. Each bail ramp includes a temporary latch notch used for short-term storage, and a lock notch used for long-term storage. These notches are used for receiving an upper portion of each bail. A "Y"-shaped release tool is used for releasing each bail from the lock notches when the container has been used for long-term storage.

These and other objects of the present invention will become apparent to those familiar with the different types of containers and receptacles used for storing liquids and other substances when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
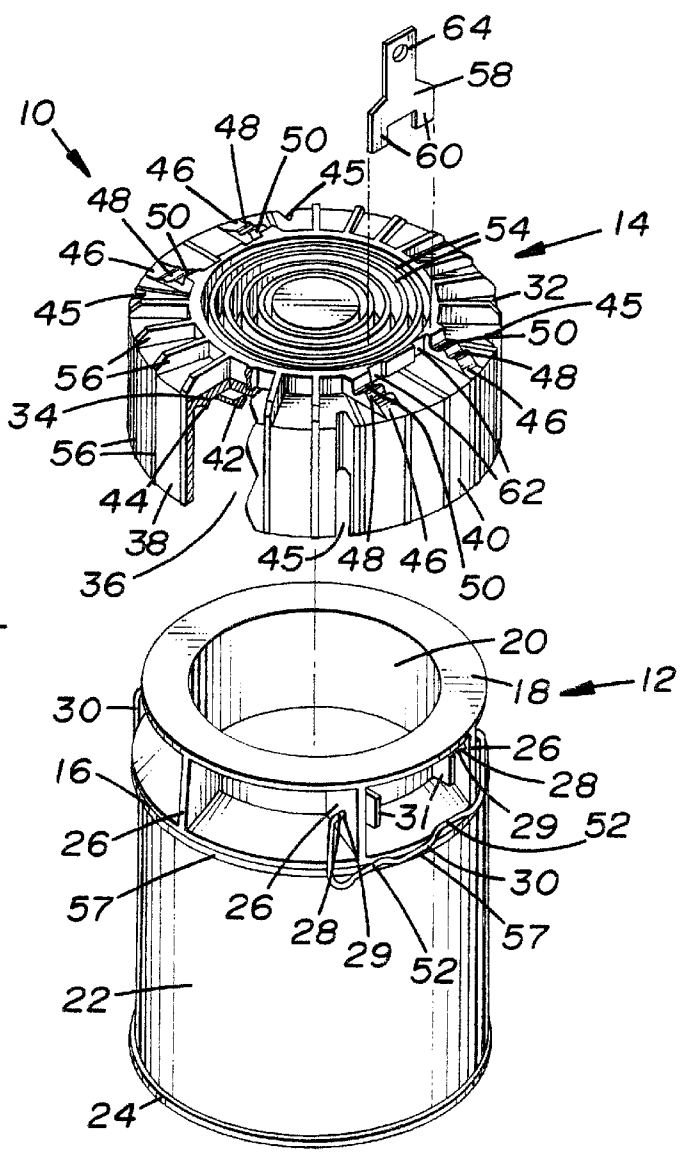
FIG. 1 is a perspective view of the subject wide-mouth container and cover device with the cover disposed above a top portion of the container and positioned for engaging the container. Also a perspective view of the "Y"-shaped release tool is shown positioned above a pair of recesses in the upper surface of the cover.

In FIG. 1, a perspective view of the subject container and cover device is shown having a general reference numeral 10. Broadly, the device 10 includes a wide-mouth container and a cover. The container and cover are also shown having general reference numerals 12 and 14. In this drawing, the cover 14 is disposed above an upper portion 16 of the container 12 and positioned for engaging a top flange 18 which is disposed around a wide-mouth opening 20 used for receiving liquids or various other types of substances therein for short and long-term storage. The container includes a lower portion 22 and a bottom 24. The top flange 18 has a diameter nearly the same as the diameter of the lower portion 22 of the container 12.

Figure 2:
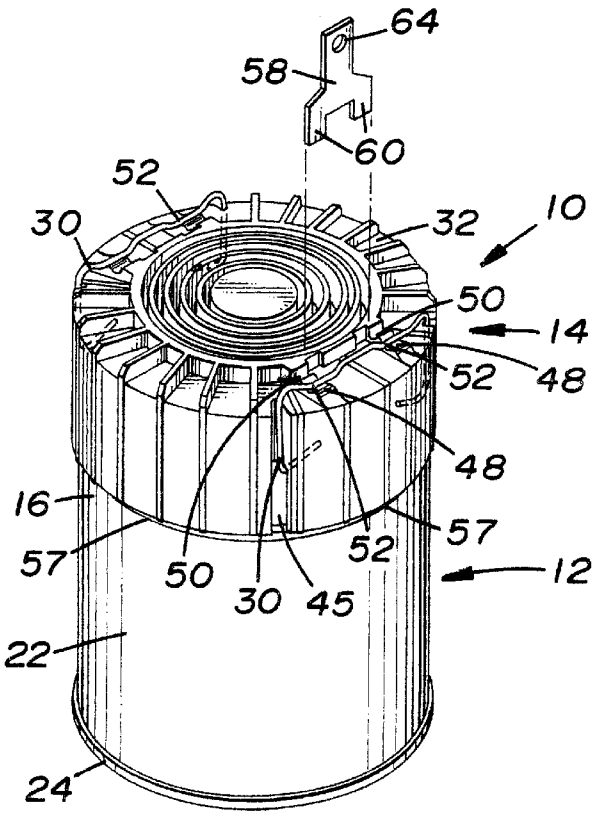
FIG. 2 is another perspective view of the subject wide-mouth container and cover device with the cover received on top portion of the container. A pair of bails are pivotly attached on the container and shown in a raised position for engaging opposite sides of an upper surface of the cover and retaining the cover on top of the container.

The upper portion 16 of the container 12 is "necked down" to provide room for six longitudinal oriented ribs 26. The ribs 26 provide structural rigidity and support for the top flange 18. Four of the ribs 26 also are used for supporting opposite ends 28 of two "C"-shaped wire bails 30. The ends 28 are received through holes 29 in the ribs 26 and are restrained from lateral movement by bail stops 31. The two bails 30 are used for engaging opposite sides of an upper surface 32 of the cover 14 for holding an interior face 34 disposed around an outer circumference of an annular recess 36 in a lower portion 38 of the cover 14, against the top flange 18 of the container 12. The annular recess 36 is used for receiving the top flange 18 therein as shown in FIG. 2. It should be mentioned, while the two bails 30 are discussed herein for securing the cover 14 on top of the container 12, it should be kept in mind that a single bail 30 could also be used equally well and received and centered on top of the cover 14.

Figure 4:
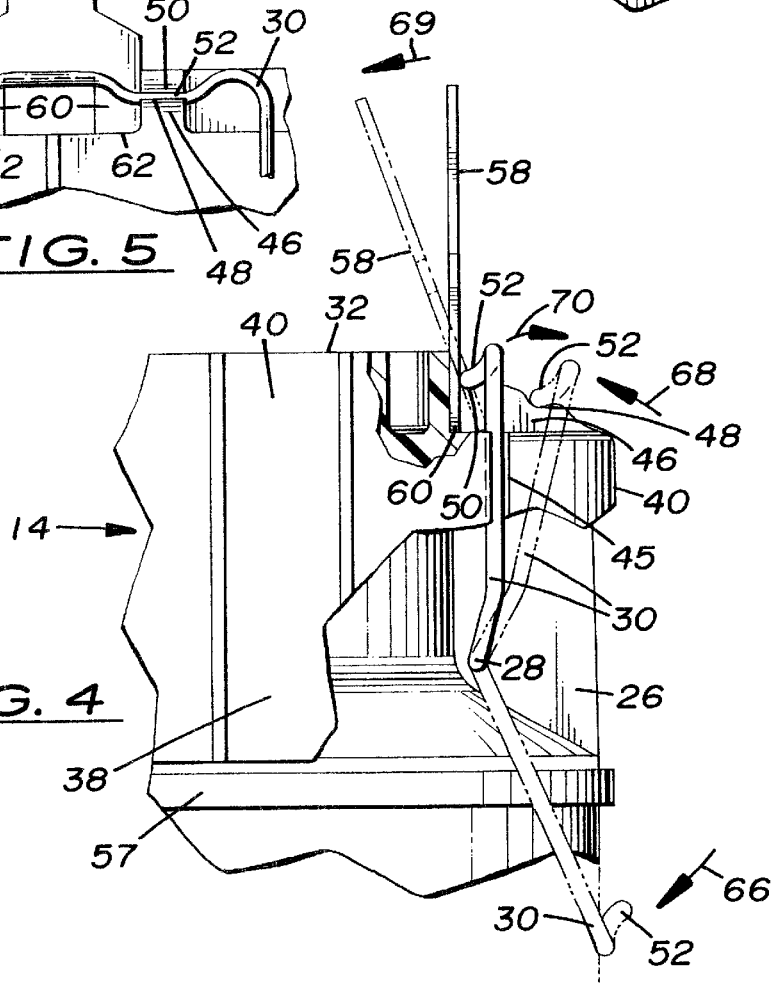
FIG. 4 illustrates a portion of the cover cut away to expose a portion of a bail supported by a longitudinally oriented rib in a non-engaged position and in two engaged positions. The two engaged positions being a lower temporary latch notch position and an upper more permanent lock notch position.

In this drawing, a portion of a side 40 of the cover 14 has been cut-away to expose the interior face 34 and a portion of the recess 36. The interior face 34 includes an annular, "V"-shaped flexible seal 42 received therein and an annular "V"-shaped spacer 44 formed in the interior face 34 and disposed therearound. The "V"-shaped flexible seal 42 is shown extending outwardly from a groove received in the interior face 34. The flexible seal 42 provides for an air-tight seal of the contents of the container 12. The seal 42, however, is of a compressible material such as rubber, and its V-shape would flatten out if not for the adjacent spacer 44. The spacer 44 is used to limit the downward movement of the cover 14 on the top flange 18. The side of the cover 14 also includes four notches 45 which are used for receiving a portion of the sides of the bails 30 when the bails 30 are pivoted upwardly for engaging the cover 14 as shown in FIG. 4.

In the upper surface 32 of the cover 14 are two pairs of spaced-apart, upwardly extending bail ramps 46. Each of the bail ramps 46 includes a lower temporary latch notch 48 used for short-term storage and an upper more permanent lock notch 50 used for long-term storage. Each pair of the notches 48 and 50 are used for releasably receiving a notch-engaging portion 52 of the bail 30 therein. The bail ramp 46 and notches 48 and 50 are seen in greater detail in FIGS. 3–5.

The upper surface 32 of the cover 14 also includes circular ribs 54 in the center of the top of the cover 14 and outwardly extending radial ribs 56. The radial ribs 56 also extend downwardly along the sides 40 of the cover 14. The combination of the ribs 54 and 56 imparts structural rigidity to the cover 14 that is needed to assure uniform contact between the underside of the cover 14 and the top flange 18 of the container 12. At the same time, the ribs 54 and 56 accommodate conventional molding and casting practice that dictates avoidance of thick cross sections. It is anticipated that the sides 40 of the cover 14 might be squeezed forcefully during the handling of the container 12 and might be deformed as a result. Therefore, the upper portion 16 of the container 12 incorporates a circumferential shoulder 57 that resists radially inward movement when the cover 14 is secured on the container 12.

Also shown in FIG. 1, is a perspective view of a "Y" shaped release tool 58 having ends 60. The ends 60 are positioned above and for receipt in a pair of recesses 62 in an upper surface 32 of the cover 14. The tool 58 also includes a hole 64 for receipt on a storage nail or the like when the tool 58 is not in use and is stored out of reach of young children. The use of the release tool 58 is described in FIGS. 3 and 4.

Figure 3:
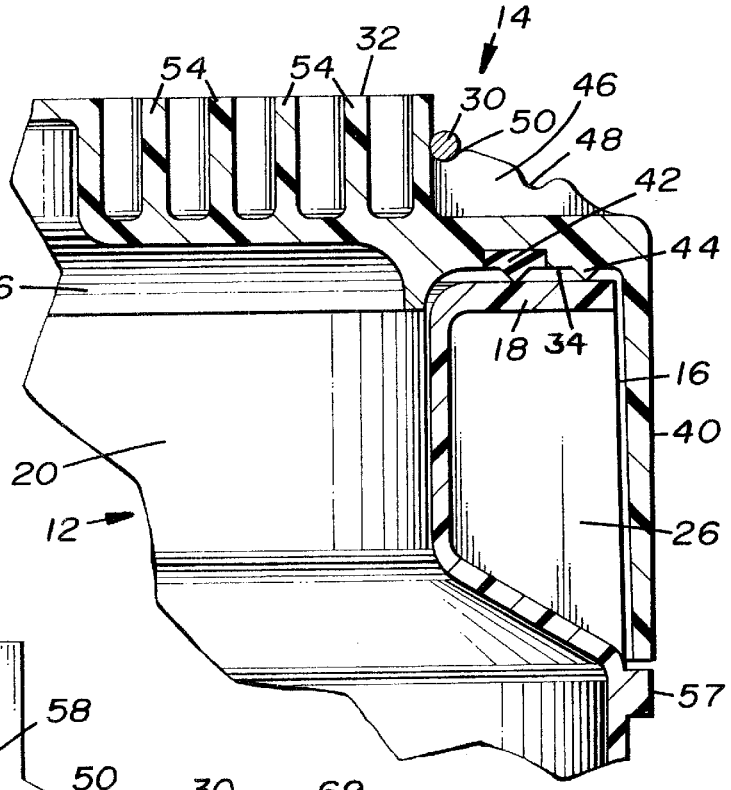
FIG. 3 is a partial sectional view of the container with the cover received on a top flange of an upper portion of the container. A portion of a bail is shown in cross section and received in a lock notch at the top of a bail ramp on the upper surface of the cover. In this position, the bail has secured the cover to the container for long-term storage. Also shown in this view is a cross section of an annular "V"-shaped flexible seal disposed around an annular recess in a lower surface of the cover. Further, an annular "V"-shaped spacer, integral with the cover, is disposed next to the flexible seal.

In FIG. 3, an enlarged sectional view of a portion of the container 12 and cover 14 are shown. In this view, the cover 14 is shown received on the top flange 18 of the upper portion 16 of the container 12. A portion of a bail 30 is shown in cross section received in the lock notch 50 at the top of the bail ramp 46. In this position, the bail 30 is securing the cover 14 to the container 12 for long-term storage.

Also shown in this view is a cross section of the "V"-shaped flexible seal 42 in the interior face 34 of the annular recess 36 of the cover 14. Further, the "V"-shaped spacer 44 is shown disposed next to the flexible seal 42. As mentioned above, the "V"-shapes of the flexible seal 42 and spacer 44 are designed wherein the bottoms or points of their "V"-shapes are pressed against the top flange 18, providing minimum contact and an airtight seal thereon for ease in release when engaging the top flange 18.

In FIG. 4, a portion of the cover 14 is shown with a part of the lower portion 38 of the cover 14 cut away. In this view, one end 28 of the bail 30 is seen supported by a longitudinally oriented rib 26 in which hole 29 acts as a pivot point for the bail 30. The bail 30 is shown in dashed lines in a lowered position as indicated by arrow 66 and resting against the side of the upper portion 16 of the container 12. The bail 30 is also shown in dashed lines in a raised position as indicated by arrow 68 with the notch-engaging portion 52 placed in tension and received in the temporary latch notch 48. It should be mentioned, that when the bail 30 is received in the latch notch 48, the bail 30 can be fairly easily released from notch 48 while the cover 14 is susceptible to dislodgement should the container 12 be dropped accidentally. Thus the engagement of the bail in the latch notch 48 is considered as providing only temporary protection to the contents in the container 12.

Further in FIG. 4, the bail 30 is shown in solid lines and in tension in a raised vertical position with the notch engaging portion 52 of the bail 30 received in the more permanent lock notch 50. To release the bail 30 from the locked position in the lock notch 50, leverage is needed and is most easily applied using the "Y"-shaped tool 58. In this example, the ends 60 of the tool 58 are received in the recesses 62 which are next to the top of the bail ramps 46. In this position, the tool 58 rests between a portion of the upper surface 32 of the cover 14 and the notch-engaging portion 52 of the bail 30. Using the upper extremities of the recesses 62 as a fulcrum, the tool 58 is rotated counter-clockwise as indicated by arrow 69. When this occurs, there is sufficient leverage to overcome the compressive force of the bail 30 against the lock notch 50 and the bail 30 is released as indicated by arrow 70. The cover 14 is now free to be removed from the top flange 18 of the container 12.

It should be noted, when the bails 30 engage either the latching notches 48 or the locking notches 50 of the bail ramps 46, the cover 14 moves against the resistance of the flexible seal 42 until the bottom of the spacer 44 contacts the container flange 18. At this position, the flexible seal 42 is sufficiently deformed as to prevent outside-air entry into the container 12. The combined surface area of the seal 42 and the spacer 44 in contact with the top flange 18 is at a minimum by the virtue of their V-shapes. This contact minimization assures that the cover 14 will be easy to remove at a later date, even if some of the substance stored in the container 12 is present on the top flange 18 when the cover 14 is installed. Without the contact minimization, the substance could act as an adhesive after drying and therefore prevent easy removal of the cover 14.

Figure 5:
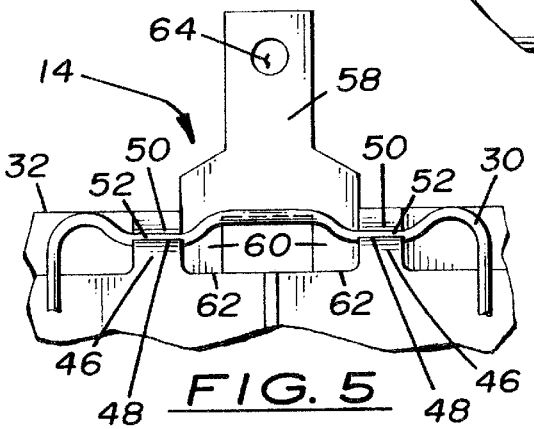
FIG. 5 shows a front view of the "Y"-shaped release tool positioned next to the a portion of the bail resting in the temporary latch notches in a pair of bail ramps.

It also should be noted that the particular geometry of the bail ramps 46 is such that relatively little force on the bail 30 is required to move it from its lowered position into the latch notches 48, but considerably more force must be applied to move it from that notch into the lock notch 50. Since these movements of the bail 30 are intended to be effected by hand pressure, its upper portion is configured such that the middle and outer extremities are higher than its notch-engaging portions 52, as shown in FIG. 5. That configuration facilitates applying the forces without the aid of a tool. Concurrent with the movement of the bail 30 over the ramps 46 as it approaches the lock notches 50 is a progressively increasing deformation or stretching over its "C" shape. The deformation does not cause permanent damage to the bail 30, however, since it is manufactured from tempered-steel wire.

In FIG. 5, a front view of the "Y" shaped release tool 58 is shown and positioned in the recesses 62. The ends 62 of the tool 58 are shown next to the notch-engaging portion 52 of the bail 30. In this drawing, the notch-engaging portion 52 is shown resting in the temporary latch notch 48 in the bail ramp 46. As mentioned above, normally the release tool 58 is not required to release the bail 20 from the latch notch 48 but it can be used if desired for ease in removal.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

What is claimed is:

1. A recloseable container and cover device for holding liquids, the device comprising:

a cylindrical container, said container having a lower portion and an upper portion, the upper portion having an opening therein with a top flange disposed around said opening;

a bail, said bail having ends pivotally attached to a side of said container;

a cylindrical cover, said cover having a lower surface adapted for receipt on top of said top flange, said bail adapted for engaging a bail ramp on an upper surface of said cover for holding a lower surface of said cover against said top flange of said container, said bail ramp having at least one notch therein for receiving a portion of said bail; and an annular flexible "V"-shaped seal in the lower surface of said cylindrical cover and therearound, said "V"-shaped seal extending downwardly for engaging a portion of said top flange for providing an air-tight seal and for providing minimum contact thereon for ease in releasing said cover from said container, wherein the lower surface of said cover includes a "W"-shaped spacer therearound and disposed next to said "V"-shaped annular flexible seal, said "V"-shaped spacer extending downwardly for engaging a portion of said top flange for limiting downward movement of said cover on said top flange, said spacer preventing the flattening out of said flexible seal on said top flange.

2. The device as described in claim 1 wherein said at least one notch in said bail ramp is a latch notch therein for receiving a portion of said bail during temporary storage.

3. The device as described in claim 1 wherein said at least one notch is said bail ramp is a lock notch therein for receiving a portion of said bail during more permanent storage.

4. A recloseable container and cover device for holding liquids, the device comprising:

a cylindrical container, said container having a lower portion and an upper portion, the upper portion having an opening therein with a top flange disposed around said opening;

a pair of bails, said bails having ends pivotally attached to opposite sides of said container;

a cylindrical cover, said cover having a lower surface adapted for receipt on top of said top flange, said bails adapted for engaging two pair of upwardly extending bail ramps on opposite sides of an upper surface of said cover for holding a lower surface of said cover against said top flange of said container, each said bail ramp having a first notch and a second notch for receiving a portion of one of said bails;

annular flexible "V"-shaped seal in the lower surface of said cylindrical cover and therearound, said flexible "V"-shaped seal extending downwardly for engaging a portion of said top flange for providing an air-tight seal and for providing minimum contact thereon for ease in releasing said cover from said container; and wherein the lower surface of said cover includes a "V"-shaped spacer therearound and disposed next to said "V"-shaped annular flexible seal, said "V"-shaped spacer extending downwardly for engaging a portion of said top flange for limiting downward movement of said cover on said top flange, said spacer preventing the flattening out of said flexible seal on said top flange.

5. The device as described in claim 4 wherein said first notches on said bail ramps are latch notches for temporary storage.

6. The device as described in claim 4 wherein said second notches on said bail ramps are lock notches for permanent storage.

7. The device as described in claim 6 further including a space disposed between said bail ramps, said space adapted for receiving ends of a "Y" shaped tool, the ends releasably engaging a portion of said bails, the tool used to release said bails from said lock notches in said bail ramps.

8. A recloseable container and cover device for holding liquids, the device comprising:

a cylindrical container, said container having a lower portion and an upper portion, the upper portion having an opening therein with a top flange disposed around said opening;

a pair of bails, said bails having ends pivotally attached to opposite sides of said container;

a cylindrical cover, said cover having a lower surface adapted for receipt on top of said top flange, said bails adapted for engaging two pairs of upwardly extending bail ramps, said ramps disposed on opposite sides of an upper surface of said cover, said bails for holding a lower surface of said cover against said top flange of said container, each said bail ramp having a latch notch therein for receiving a portion of said bails during temporary storage, each said bail ramp having a lock notch therein for receiving a portion of said bails during more permanent storage;

an annular flexible "V"-shaped seal in the lower surface of said cylindrical cover and therearound, said flexible "V"-shaped seal extending downwardly for engaging a portion of said top flange for providing an air-tight seal and for providing minimum contact thereon for ease in releasing said cover from said container; and an annular "V"-shaped spacer in the lower surface of said cylinder cover and disposed next to said "V"-shaped annular flexible seal, said "V"-shaped spacer for engaging a portion of said top flange for limiting downward movement of said cover on said top flange, said spacer preventing the flattening out of said flexible seal on said top flange.

9. The device as described in claim 8 further including a space disposed between said bail ramps, said space adapted for receiving ends of a "Y" shaped tool, the ends releasably engaging a portion of said bails, the tool used to release said bails from said lock notches in said bail ramps.

10. The device as described in claim 8 further includes a plurality of longitudinal ribs formed in the upper portion of said container, the ends of said bails pivotally attached to a portion of said longitudinal ribs.

* * * * *